US011102585B2

(12) United States Patent
Devantier et al.

(10) Patent No.: US 11,102,585 B2
(45) Date of Patent: Aug. 24, 2021

(54) ULTRA SLIM TRANSDUCER

(71) Applicant: SAMSUNG ELECTRONICS CO., LTD., Suwon-si (KR)

(72) Inventors: Allan Devantier, Newhall, CA (US); Felix C. Kochendoerfer, Los Angeles, CA (US); Andri Bezzola, Pasadena, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/588,905

(22) Filed: Sep. 30, 2019

(65) Prior Publication Data

US 2020/0280805 A1 Sep. 3, 2020

Related U.S. Application Data

(60) Provisional application No. 62/811,781, filed on Feb. 28, 2019.

(51) Int. Cl.
*H04R 7/04* (2006.01)
*H04R 9/06* (2006.01)
(Continued)

(52) U.S. Cl.
CPC ..... *H04R 9/06* (2013.01); *H04R 7/04* (2013.01); *H04R 7/18* (2013.01); *H04R 9/025* (2013.01)

(58) Field of Classification Search
CPC ..... H04R 2440/00–07; H04R 7/04
(Continued)

(56) References Cited

U.S. PATENT DOCUMENTS 4,720,867 A * 1/1988 Imai ..... B60R 11/0217 381/152
RE32,785 E * 11/1988 Hirano ..... H04R 1/04 381/194
(Continued)

FOREIGN PATENT DOCUMENTS

JP 2000059884 A 2/2000
JP 2005223806 A 8/2008
(Continued)

OTHER PUBLICATIONS

International Search Report and Written Opinion dated Jun. 10, 2020 for International Application PCT/KR2020/001659 from Korean Intellectual Property Office, pp. 1-20, Republic of Korea (English-language translation included pp. 1-10).

*Primary Examiner* — Suhan Ni
(74) *Attorney, Agent, or Firm* — Sherman IP LLP; Kenneth L. Sherman; Steven Laut

(57) ABSTRACT

One embodiment provides a slim acoustic transducer with a diaphragm including a hole that is substantially centered on a vertical axis of the diaphragm. The hole has a first horizontal width. A voice coil has a ring shape that is disposed at least partially within the hole and substantially centered on the vertical axis. The ring shape has an outer and inner horizontal width. The outer horizontal width is smaller than or equal to the first horizontal width of the hole. A column structure is disposed at least partially within the ring shape and substantially centered on the vertical axis. The column structure has a second horizontal width that is smaller than or equal to the inner horizontal width of the ring shape. The column structure includes an upper magnet, a middle plate disposed below the upper magnet and a lower magnet disposed below the middle plate.

20 Claims, 16 Drawing Sheets

(51) Int. Cl.
*H04R 7/18* (2006.01)
*H04R 9/02* (2006.01)

(58) Field of Classification Search
USPC ..... 381/152, 431
See application file for complete search history.

(56) References Cited

U.S. PATENT DOCUMENTS

| | | | | |
|---|---|---|---|---|
| 6,519,349 | B1 * | 2/2003 | Azima | B42D 15/022 381/152 |
| 8,958,597 | B2 | 2/2015 | Boyd | |
| 10,250,997 | B2 | 4/2019 | Pinkerton et al. | |
| 2003/0059079 | A1 | 3/2003 | Asahina et al. | |
| 2005/0286729 | A1 * | 12/2005 | Harwood | H04R 7/04 381/152 |
| 2007/0125591 | A1 | 6/2007 | Sahyoun et al. | |
| 2013/0251176 | A1 * | 9/2013 | Goto | H04R 1/00 381/152 |
| 2017/0332174 | A1 | 11/2017 | Lee et al. | |
| 2018/0084346 | A1 | 3/2018 | Yang | |

FOREIGN PATENT DOCUMENTS

| | | | |
|---|---|---|---|
| JP | 2009044357 | A | 2/2009 |
| JP | 4361580 | B2 | 11/2009 |
| JP | 2010-193414 | A | 9/2010 |
| KR | 10-0535172 | B1 | 4/2003 |
| KR | 10-0654819 | B1 | 8/2006 |
| KR | 10-2011-0038883 | A | 4/2011 |
| KR | 10-2017-0127338 | A | 11/2017 |
| WO | 2001/035698 | A1 | 5/2001 |

* cited by examiner

ULTRA SLIM TRANSDUCER

CROSS-REFERENCE TO RELATED APPLICATIONS

The present application claims priority to U.S. Provisional Patent Application No. 62/811,781, filed on Feb. 28, 2019, hereby incorporated by reference in its entirety.

COPYRIGHT DISCLAIMER

A portion of the disclosure of this patent document may contain material that is subject to copyright protection. The copyright owner has no objection to the facsimile reproduction by anyone of the patent document or the patent disclosure as it appears in the patent and trademark office patent file or records, but otherwise reserves all copyright rights whatsoever.

TECHNICAL FIELD

One or more embodiments relate generally to transducers, and in particular, to a slim acoustic transducer with a diaphragm including a hole that is substantially centered on a vertical axis of the diaphragm.

BACKGROUND

Televisions, laptops, and phones are becoming thinner, but there is still demand for better sound quality (e.g., more bass output). In order to produce low frequency sound (e.g., bass), a loudspeaker has to move a lot of air which can be achieved either by a large surface area or large excursion of the diaphragm. A high surface area of shallow transducers is prone to bending and rocking, which introduces distortion and other mechanical problems.

Often it is not possible to have the diaphragm exposed. Instead, the sound has to radiate through a narrow slot, which increases the overall built height (thickness) of the acoustic module. Advantages of slot loading the transducer include preventing it from being touched and also minimizing interference with industrial design. Slot loading a shallow transducer, however, also makes it more prone to rocking because the acoustic load on the diaphragm becomes asymmetric.

SUMMARY

One embodiment provides a slim acoustic transducer with a diaphragm including a hole that is substantially centered on a vertical axis of the diaphragm. The hole has a first horizontal width. A voice coil has a ring shape that is disposed at least partially within the hole and substantially centered on the vertical axis. The ring shape has an outer horizontal width and an inner horizontal width. The outer horizontal width is smaller than or equal to the first horizontal width of the hole. A column structure is disposed at least partially within the ring shape and substantially centered on the vertical axis. The column structure has a second horizontal width that is smaller than or equal to the inner horizontal width of the ring shape. The column structure includes an upper magnet, a middle plate disposed below the upper magnet and a lower magnet disposed below the middle plate.

These and other features, aspects and advantages of the one or more embodiments will become understood with reference to the following description, appended claims and accompanying figures.

DETAILED DESCRIPTION

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to transducers, and in particular, to slim acoustic transducers with a diaphragm including a hole that is substantially centered on a vertical axis of the diaphragm. One embodiment provides a slim acoustic transducer with a diaphragm including a hole that is substantially centered on a vertical axis of the diaphragm. The hole has a first horizontal width. A voice coil has a ring shape that is disposed at least partially within the hole and substantially centered on the vertical axis. The ring shape has an outer horizontal width and an inner horizontal width. The outer horizontal width is smaller than or equal to the first horizontal width of the hole. A column structure is disposed at least partially within the ring shape and substantially centered on the vertical axis. The column structure has a second horizontal width that is smaller than or equal to the inner horizontal width of the ring shape. The column structure includes an upper magnet, a middle plate disposed below the upper magnet and a lower magnet disposed below the middle plate.

For expository purposes, the terms "loudspeaker," "loudspeaker device," and "loudspeaker system" may be used interchangeably in this specification.

For expository purposes, the term "listening position" as used in this specification generally refers to a position of a listener relative to a loudspeaker device.

For expository purposes, a diaphragm is a membrane attached to a voice coil, which moves in a magnetic gap, vibrating the diaphragm, and producing sound.

Figure 1:
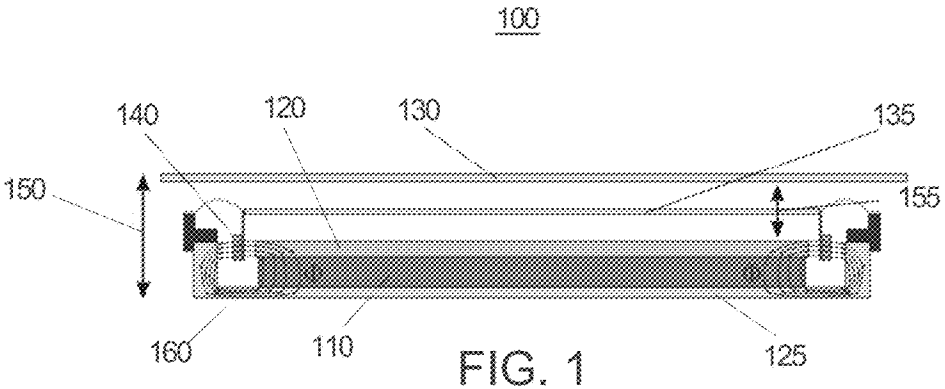
FIG. 1 (Prior Art)
FIG. 1 illustrates a cross-sectional view of a conventional flat micro-speaker.

FIG. 1 illustrates a cross-sectional view of a conventional flat micro-speaker 100. The conventional flat micro-speaker 100 includes a magnet 110, a top plate 120, bottom plate (or frame) 125, grill (or front cover) 130, diaphragm 135 and voice coils 140. The magnet 110 system portion of the conventional flat micro-speaker 100 takes up significant amount of space and limits the excursion of the diaphragm 135 relative to the overall built height 150 (acoustic module thickness, including the enclosure). The peak-to-peak displacement 155 of the diaphragm can be less than 40% of overall thickness. The magnetic flux 160 is formed between the magnet 110 and the voice coils 140.

Figure 2A:
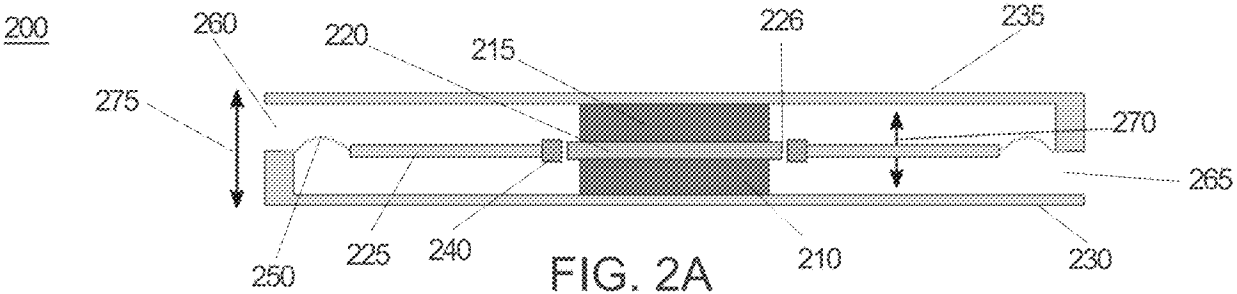
FIG. 2A illustrates a cross-sectional view of an example ultra-thin transducer, according to some embodiments.

FIG. 2A illustrates a cross-sectional view of an example ultra-thin transducer 200, according to some embodiments. In some embodiments, the transducer 200 includes a magnet system including a lower (or bottom) magnet 210 (e.g., ring-shaped, circular-shaped, cylindrical shaped, etc.), a middle plate 220 (e.g., ring-shaped, circular-shaped, cylindrical shaped, etc.), an upper (or top) magnet 215 (e.g., ring-shaped, circular-shaped, cylindrical shaped, etc.) and the voice coil 240 (e.g., ring-shaped, circular-shaped, oval-shaped, etc.). In some embodiments, the magnet system has a column structure disposed at least partially within the inner perimeter of the voice coil 240 and substantially centered on the vertical axis. The column structure has a horizontal width that is smaller than or equal to the inner horizontal width of the voice coil 240 structure shape. The column structure includes: the upper magnet 215, the middle plate 220 that is disposed below the upper magnet 215, and the lower magnet 210 that is disposed below the middle plate 220. The magnet system minimizes the amount of space from the excursion of the diaphragm 225. In some embodiments, the lower magnet 210 and the upper magnet 215 may be comprised of rare earth magnetic material, such as: Neodymium (Nd), Nd Iron Boron (NdFeB), Samarium Cobalt, etc. In some embodiments, the middle plate 220 may be made of low carbon steel, soft magnetic steel, or similar material. In some embodiments, the diaphragm 225 may be made of paper, polypropylene (PP), polyetheretherketone (PEEK) polycarbonate (PC), Polyethylene Terephthalate (PET), silk, glass fiber, carbon fiber, titanium, aluminum, aluminum-magnesium alloy, nickel, beryllium, etc.

In some embodiments, the top plate of the column structure may be the top magnet 215 that may be ring-shaped and substantially centered on the vertical axis and assists in directing at least some of the upper magnetic field substantially parallel to the vertical horizontal axis in proximity to and away from the voice coil 240. The bottom plate of the column structure may include the lower magnet 210 that may be a magnetic ring substantially centered on the vertical axis and configured to assist in directing at least some of the lower magnetic field substantially parallel to horizontal axis in proximity to the vertical axis away from the voice coil 240. In some embodiments, the enclosure including the lower frame 230 and the upper frame 235 (e.g., low carbon steel, soft magnetic steel, plastic, aluminum, etc.) doubles as a magnetic return path. In some embodiments, the peak-to-peak displacement 270 can be greater than 50% of overall thickness 275.

In one or more embodiments, the diaphragm 225 may include or be connected with an outer suspension 250 (e.g., a torus, etc.). The transducer 200 may include a slot or venting 260 for radiating sound waves outside of the transducer 200 to the listening environment, and a slot or venting 265 for venting to the internal speaker volume. In some embodiments, the top and bottom plates of the column structure may be part of the frame (i.e., the lower frame 230 and the upper frame 235).

In some embodiments, the diaphragm 225 includes a hole (or space, opening, etc.) 226 that is substantially centered on a vertical axis of the diaphragm 225, the hole 226 has a horizontal width. The voice coil 240 may have a shape (e.g., a ring shape, circular-shape, oval-shape, etc.) that is disposed at least partially within the hole 226 and substantially centered on the vertical axis of the diaphragm 225. The shape of the voice coil 240 may have an outer horizontal width and an inner horizontal width, where the outer horizontal width is smaller than or equal to the horizontal width of the hole 226.

In some embodiments, the magnet system produces low frequency output in a very thin form factor. The transducer 200 can optimize stack-up topology for maximum displacement. In accordance with some embodiments, the enclosure becomes a functional part of the transducer 200 design. In some embodiments, the magnet system (or motor) of transducer 200 is placed in the center of the diaphragm 225 (not below as in conventional designs), providing for a thin design with an increased range of motion. In some cases, there is no yoke/gap (direct magnetic return path), utilizing fringe field of the magnet system, increasing the range of motion of the diaphragm 225. The transducer 200 also improves symmetry of electromagnetic force and inductance during in-/out-stroke. In some embodiments, the transducer 200 provides a symmetric magnet layout, which improves sound quality by reducing distortion.

In some embodiments, the transducer 200 may include a steel housing used for a magnetic return path on both sides of the column structure (no additional thickness required for enclosure). The diaphragm 225 can be mounted at the center of the voice coil 240, which improves symmetry in in-/out-stroke. This also reduces or eliminates the former (bobbin) used in conventional transducers designs. Moreover, strategically placed air vents of the transducer 200 can reduce rocking modes of the diaphragm 225, which reduces distortion and the potential for the voice coil 240 to rub against the magnet system structure. In some embodiments, the transducer 200 may be implemented in devices and microelectronic equipment, such as mobile phones, camcorders, personal digital assistants (PDAs), digital cameras, notebook computers, TVs, DVDs, etc.

Figure 2B:
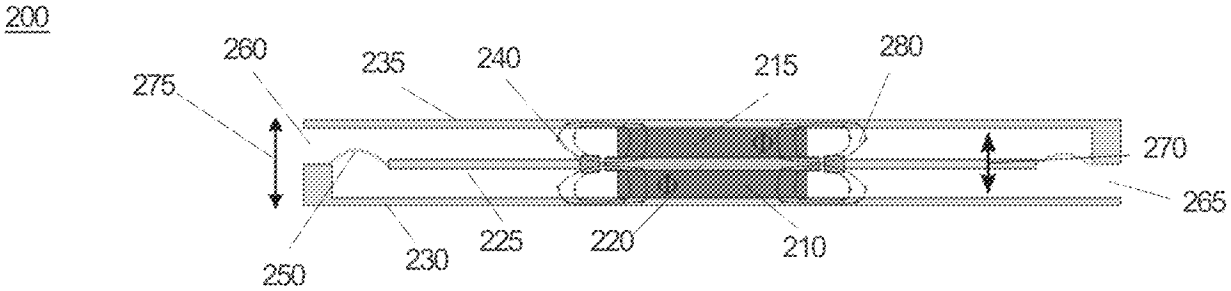
FIG. 2B illustrates a cross-sectional view of an example ultra-thin transducer showing example magnetic flux, according to some embodiments.

FIG. 2B illustrates a cross-section of an example ultra-thin transducer 200 showing example magnetic flux 280, according to some embodiments. In some embodiments, the lower magnet 210 and the upper magnet 215 have opposing polarity to increase the magnetic flux 280 on the edge of the pole plate. The voice coil 240 and magnet system structure are located centrally inside the diaphragm 225. The magnet system is centrally located within the driver and the symmetric motor design reduces even order harmonic distortion.

Figure 3:
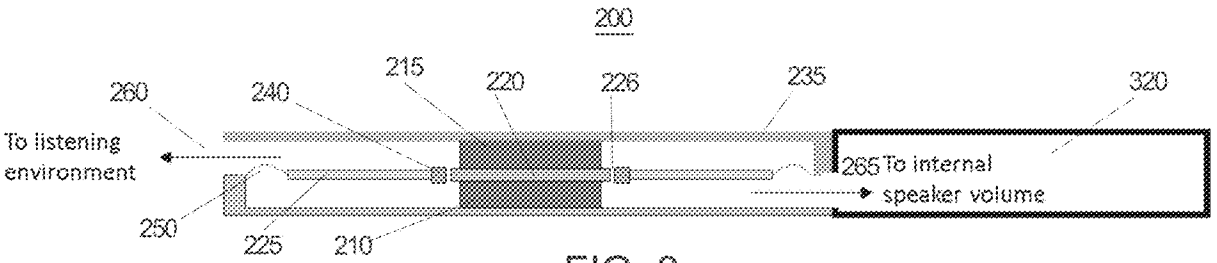
FIG. 3 illustrates a cross-sectional view of an example of a slot-loaded ultra-thin transducer showing top and bottom venting, according to some embodiments.

FIG. 3 illustrates a cross-sectional view of the example slot-loaded ultra-thin transducer 200 showing top slot 260 and bottom slot 265 venting, according to some embodiments. In some embodiments, the transducer 200 vents straight out the top slot 260 to the listening environment, and straight out of the bottom slot 265 to vent to the internal speaker volume 320.

Figure 4:
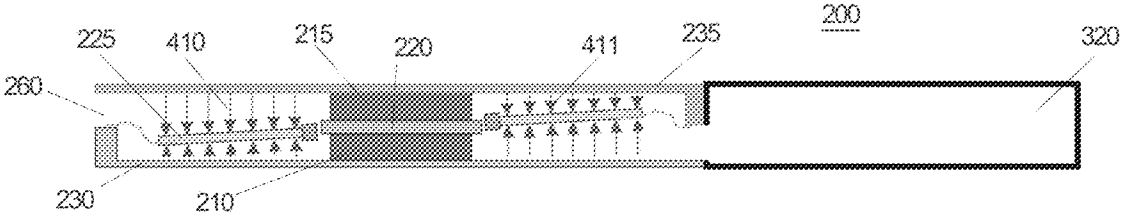
FIG. 4 illustrates a cross-sectional view of an example of a slot-loaded ultra-thin transducer showing conventional asymmetric pressure on the diaphragm causing rocking motion, according to some embodiments.

FIG. 4 illustrates a cross-sectional view of the example slot-loaded ultra-thin transducer 200 showing conventional asymmetric pressure (indicated by the arrows 410 and 411) on the diaphragm 225 causing rocking motion, according to some embodiments. Slot loading a transducer has advantages, but slot loading a shallow transducer also makes it more prone to rocking because the acoustic load on the diaphragm becomes asymmetric. This introduces distortion and can even cause the voice coil to rub on the magnet structure. In some embodiments, the transducer 200 provides an optimized venting structure to minimize the asymmetry of the acoustic load on the diaphragm 225, which can abate the problems associated with slot loading a conventional flat transducer (e.g., flat micro-speaker 100, FIG. 1) making it more prone to rocking due to the acoustic load on the diaphragm becoming asymmetric.

A good transducer should exhibit symmetric behavior for the instroke and the outstroke. The electromagnetic force on the voice coil, coil inductance, and the suspension stiffness should be as symmetric as possible around the rest position. Conventional slim transducer designs sacrifice symmetry for a slim form factor. Some embodiments can have perfect symmetry for the electromagnetic force and coil inductance.

Figure 5A:
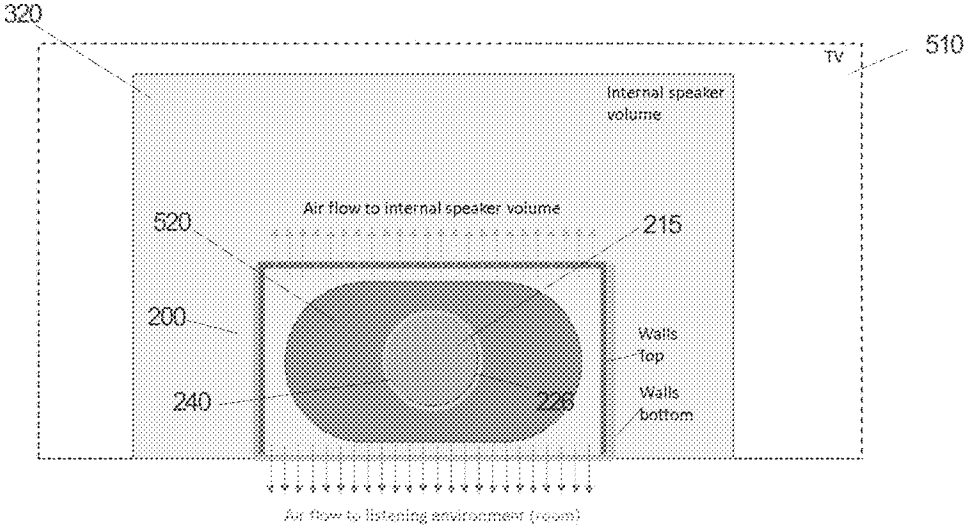
FIGS. 5A-G illustrate top views of example slot-loaded ultra-thin transducers with various air-flow venting, according to some embodiments.

FIGS. 5A-G illustrate top views of example slot-loaded ultra-thin transducers with various air-flow venting, according to some embodiments. FIG. 5A shows a top view of a slot-loaded transducer 200 and internal speaker volume 320 in a TV device 510, in accordance with conventional approaches. The transducer 200 includes an oval-shaped diaphragm 520. As can be seen looking down at the transducer 200, the voice coil 240 surrounds the magnet system around the hole 226. The transducer 200 is vented straight out to the listening environment (e.g., a room, etc.) from the top slot 260 (FIGS. 2A-B) across the entire front of the transducer 200. The transducer 200 is also vented for air flow to the internal speaker volume 320 from the bottom slot 265 (FIGS. 2A-B).

Figure 5B:
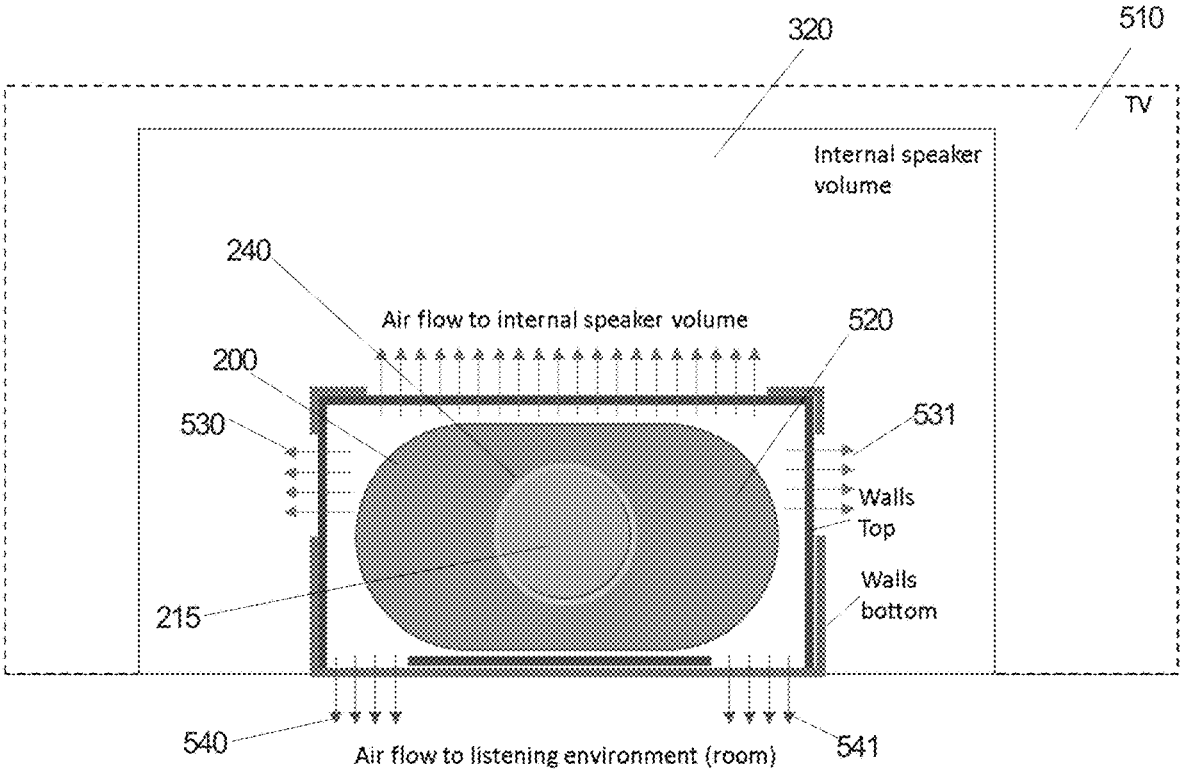

FIG. 5B shows a top view of an example slot-loaded ultra-thin transducer 200 with lateral exit slots 540/541 for air-flow venting, and an internal speaker volume 320 in a TV device 510, according to some embodiments. In some embodiments, the improved venting for the slot loaded transducer 200 forces the venting through the lateral exit slots 540 and 541, which improves the asymmetry of the diaphragm 225 (FIGS. 2A-B) load. In some embodiments, the transducer 200 includes an optimum configuration of top and bottom walls (and exit slots 530, 531 along with the slot venting to the internal speaker volume 320) that minimize the amount of rocking exhibited by the diaphragm 225.

Figure 5C:
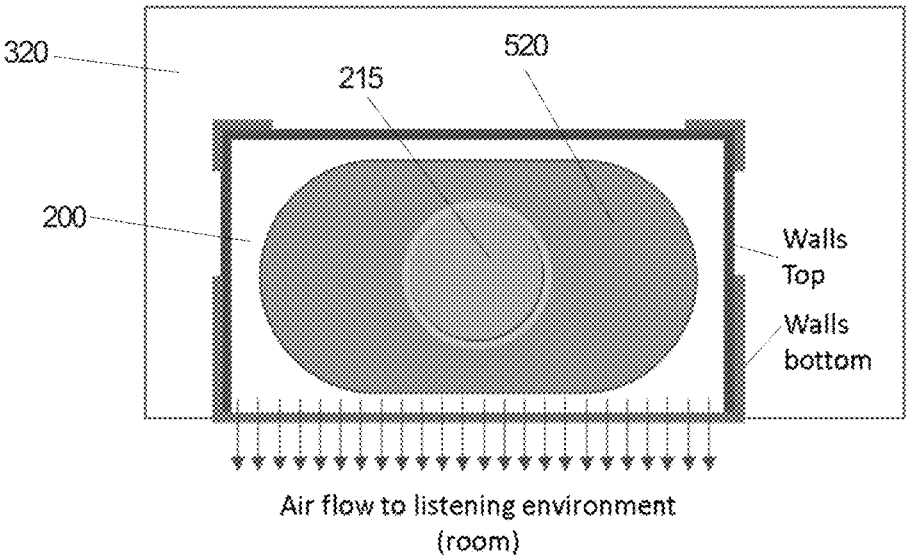
Figure 5D:
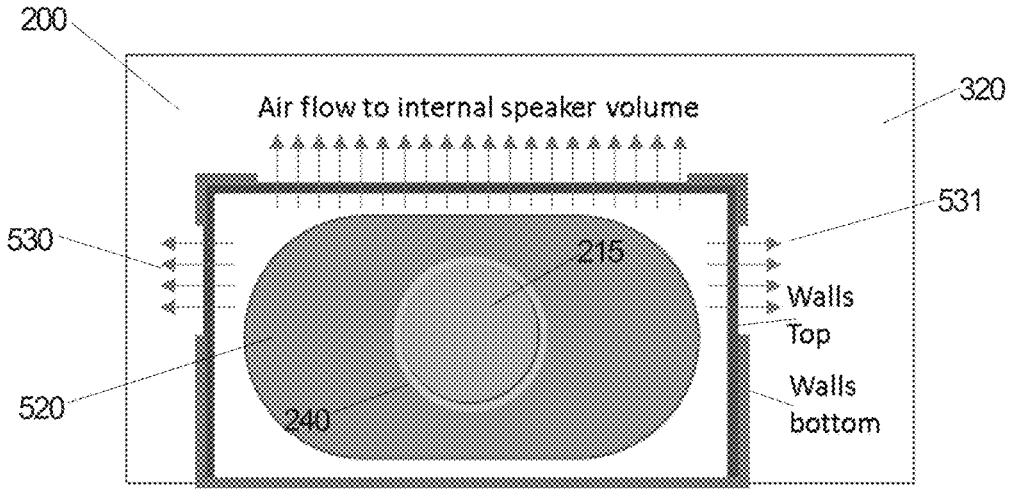
Figure 5E:
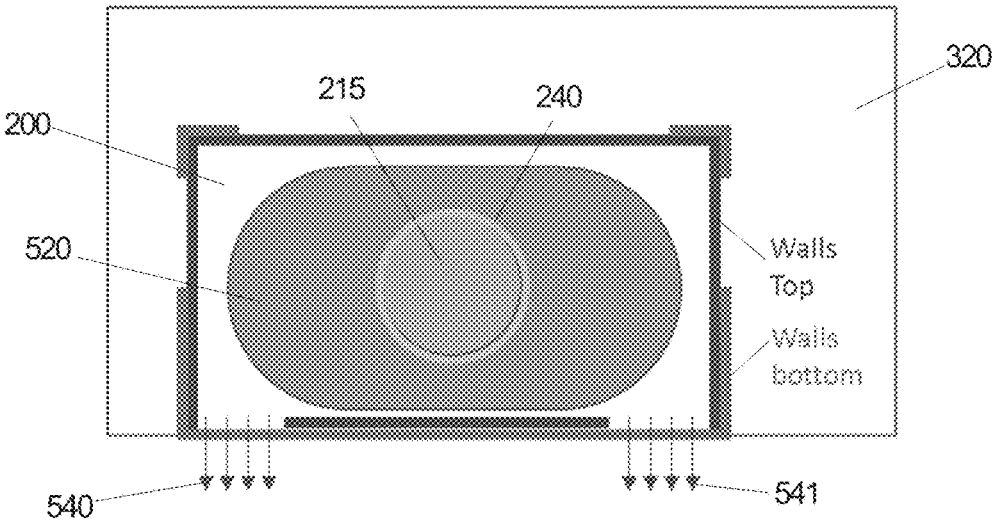
Figure 5F:
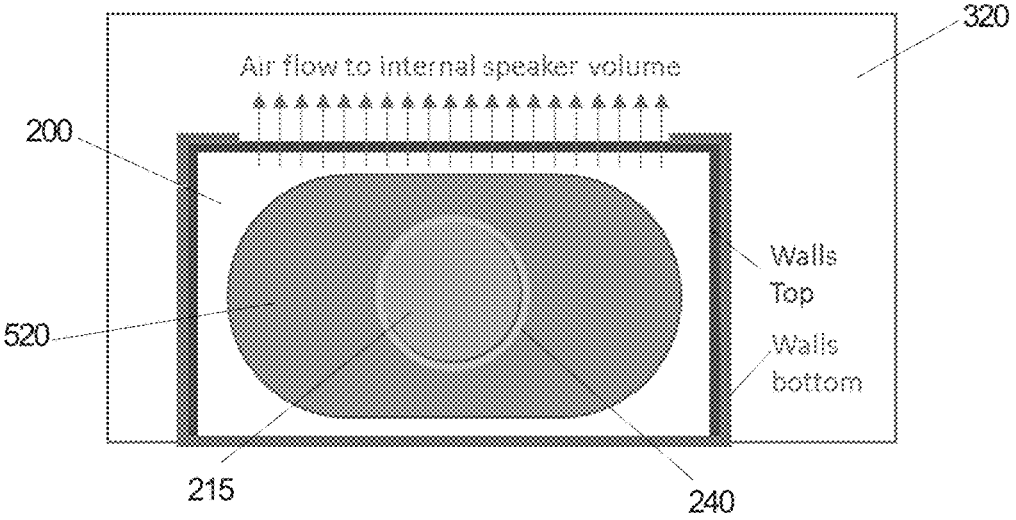
Figure 5G:
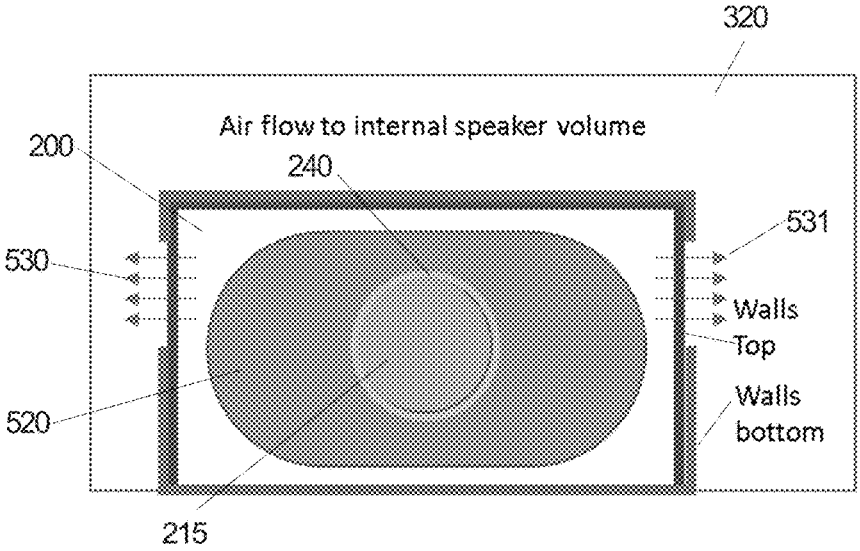

FIG. 5C shows a top view of an example slot-loaded ultra-thin transducer 200 with front open air-flow venting, according to some embodiments. FIG. 5D shows a top view of an example slot-loaded ultra-thin transducer 200 with air flow venting in the rear, center and sides to the internal speaker volume 320, according to some embodiments. FIG. 5E shows a top view of an example slot-loaded ultra-thin transducer 200 with front sides air-flow venting to the listening environment, according to some embodiments. FIG. 5F shows a top view of an example slot-loaded ultra-thin transducer 200 with rear-center air-flow venting to the internal speaker volume 320, according to some embodiments. FIG. 5G shows a top view of an example slot-loaded ultra-thin transducer 200 with back-sides air-flow venting to the internal speaker volume 320, according to some embodiments.

Figure 6:
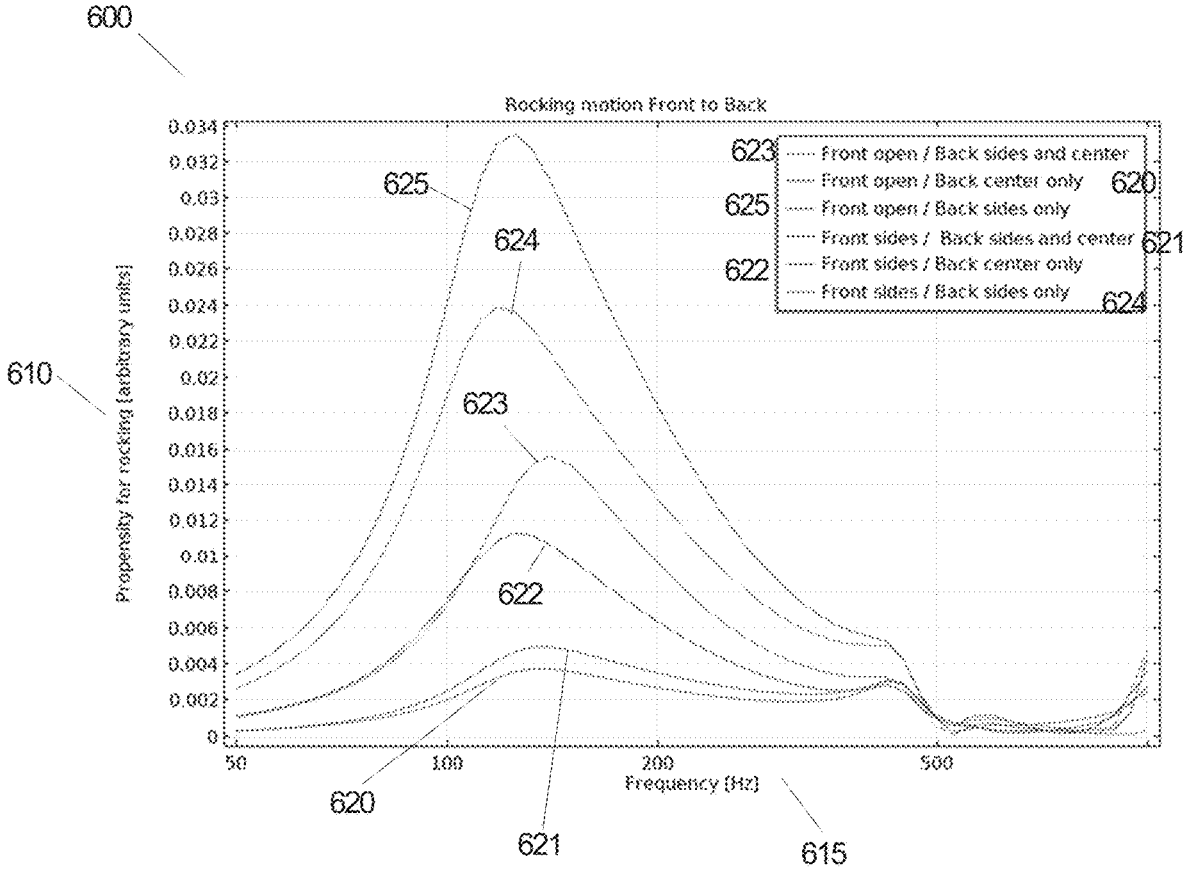
FIG. 6 illustrates a graph of propensity for rocking motion versus frequency for the examples in FIGS. 5A-G, according to some embodiments.

FIG. 6 illustrates a graph 600 of propensity for rocking motion 610 versus frequency 615 for the examples in FIGS. 5A-G, according to some embodiments. Curve 620 corresponds to the front venting open with the back-center venting open; curve 621 corresponds to the front-sides venting open with the back-sides and center open; curve 622 corresponds to the front sides venting open with the back-center venting open; curve 623 corresponds to the front venting open with the back-sides and center venting open; curve 624 corresponds to the front-sides venting open with the back-sides venting open; and curve 625 corresponds to the front venting open with the back-sides venting open. As seen in the graph 600, the least propensity for rocking is achieved for the following configurations (less is better): front open (see FIG. 5A) with back-center open (and sides closed) 620 (see FIG. 5F) and front sides (see FIG. 5B) with back-center and sides open 621 (see FIG. 5D).

Figure 7:
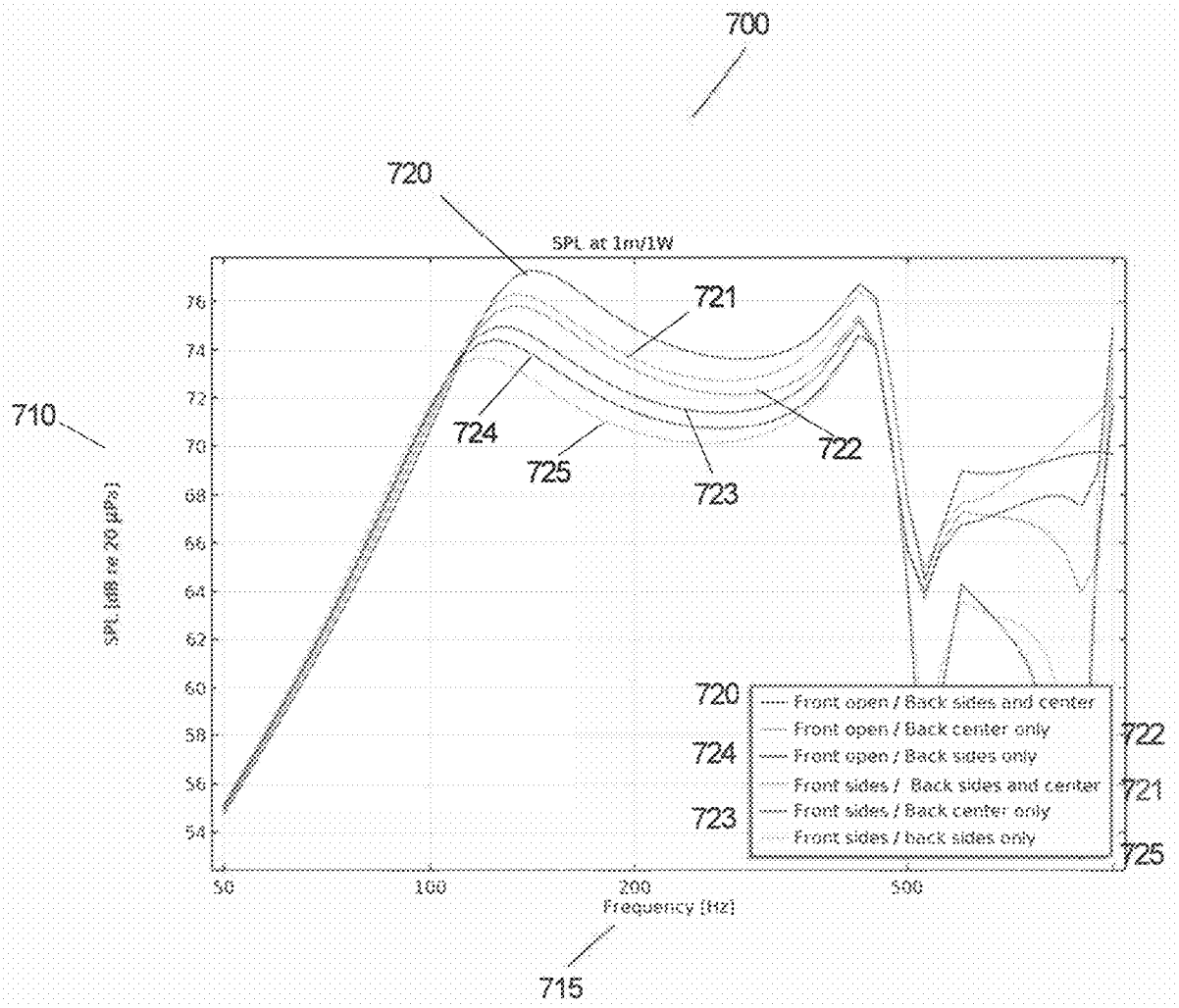
FIG. 7 illustrates a graph of sound pressure level (SPL) versus frequency for the examples in FIGS. 5A-G, according to some embodiments.

FIG. 7 illustrates a graph 700 of sound pressure level (SPL) 710 versus frequency 715 for the examples in FIGS. 5A-G, according to some embodiments. Curve 720 corresponds to the front venting open with the back-sides and center venting open; curve 721 corresponds to the front-sides venting open with the back-sides and center open; curve 722 corresponds to the front venting open with the back-center venting open; curve 723 corresponds to the front sides venting open with the back-center venting open; curve 724 corresponds to the front venting open with the back-sides venting open; and curve 725 corresponds to the front-sides venting open with the back-sides venting open. As shown, the most output occurs for the following configurations (more is better): front open (see FIG. 5C) with back center and sides open 720 (see FIG. 5D), and front sides (see FIG. 5B) with back center and sides open 721 (see FIG. 5D).

Figure 8A:
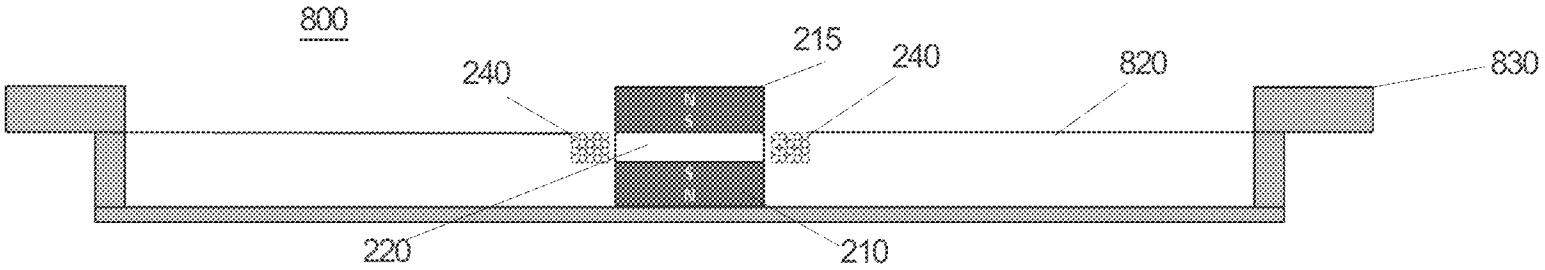
FIG. 8A illustrates a cross-sectional view of an example ultra-thin transducer with a planar diaphragm, according to some embodiments.

FIG. 8A illustrates a cross-sectional view of an example ultra-thin transducer 800 with a planar diaphragm 820, according to some embodiments. In some embodiments, the transducer 800 includes a lower magnet 210, an upper magnet 215, a middle plate 220, voice coil 240, planar diaphragm 820 and structure (or frame) 830. In some example embodiments, the structure 830 may be made of low carbon steel, soft magnetic steel, plastic, aluminum, etc.

Figure 8B:
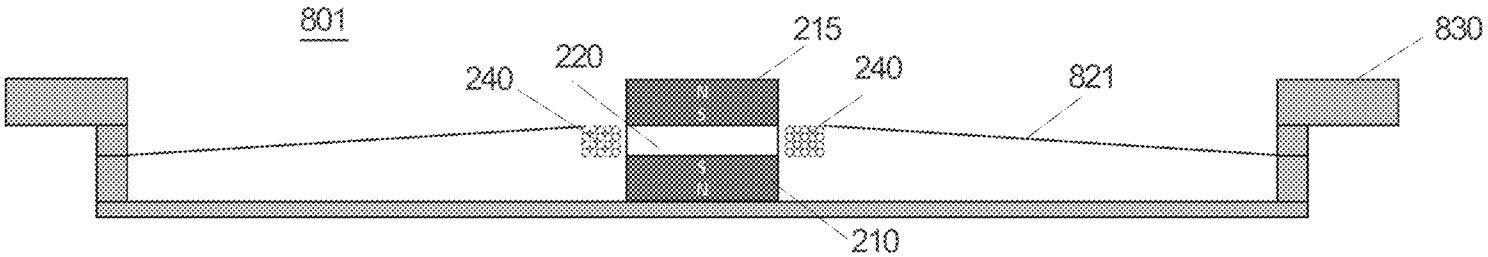
FIG. 8B illustrates a cross-sectional view of an example ultra-thin transducer with a convex angled diaphragm, according to some embodiments.

FIG. 8B illustrates a cross-sectional view of an example ultra-thin transducer 801 with a convex angled diaphragm 821, according to some embodiments. In some embodiments, the transducer 801 includes a lower magnet 210, an upper magnet 215, a middle plate 220, voice coil 240, convex angled diaphragm 821 and structure (or frame) 830.

Figure 8C:
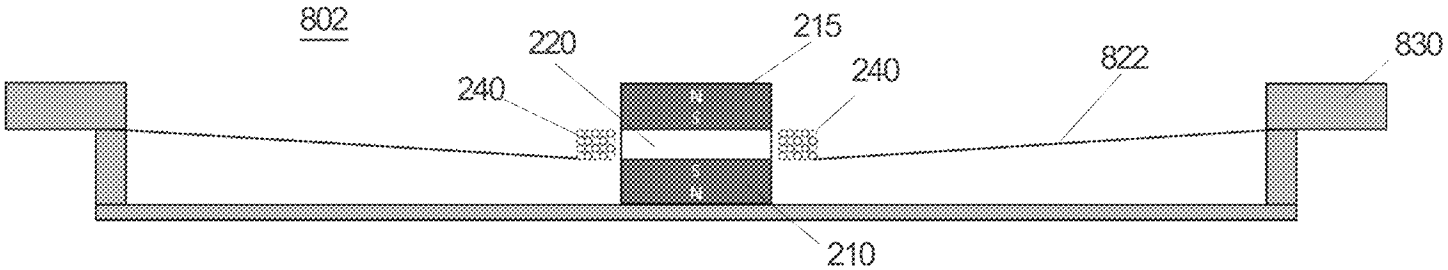
FIG. 8C illustrates a cross-sectional view of an example ultra-thin transducer with a concave angled diaphragm, according to some embodiments.

FIG. 8C illustrates a cross-sectional view of an example ultra-thin transducer 802 with a concave angled diaphragm 822, according to some embodiments. In some embodiments, the transducer 802 includes a lower magnet 210, an upper magnet 215, a middle plate 220, voice coil 240, concave angled diaphragm 822 and structure (or frame) 830.

Figure 8D:
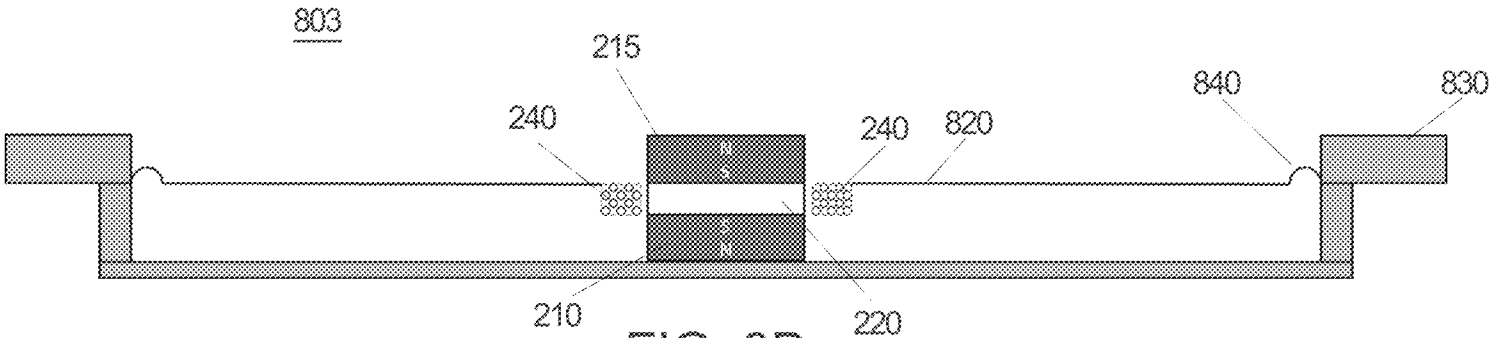
FIG. 8D illustrates a cross-sectional view of an example ultra-thin transducer with a planar diaphragm and outer suspension, according to some embodiments.

FIG. 8D illustrates a cross-sectional view of an example ultra-thin transducer 803 with a planar diaphragm 820 and outer suspension (e.g., a torus, etc.) 840, according to some embodiments. In some embodiments, the transducer 803 includes a lower magnet 210, an upper magnet 215, a middle plate 220, voice coil 240, the planar diaphragm 820, outer suspension 840 and structure (or frame) 830.

Figure 8E:
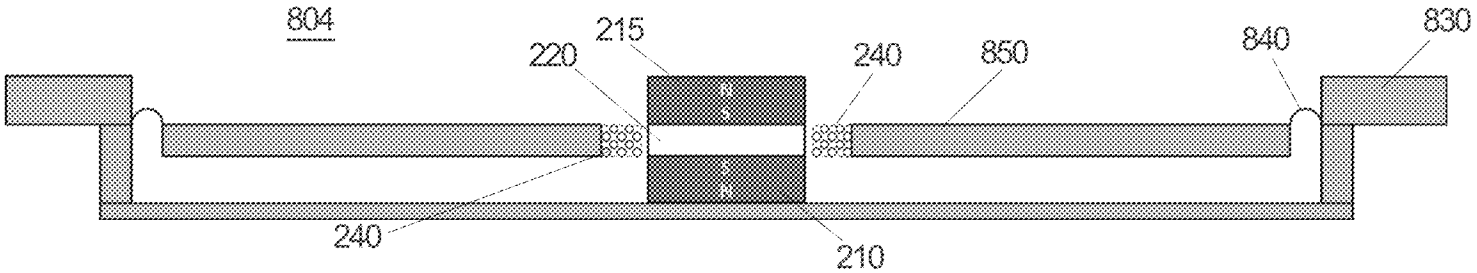
FIG. 8E illustrates a cross-sectional view of an example ultra-thin transducer with a structural diaphragm and outer suspension, according to some embodiments.

FIG. 8E illustrates a cross-sectional view of an example ultra-thin transducer 804 with a structural diaphragm 850 and an outer suspension 840, according to some embodiments. In some embodiments, the transducer 804 includes a lower magnet 210, an upper magnet 215, a middle plate 220, voice coil 240, the structural diaphragm 850, outer suspension 840 and structure (or frame) 830. In some embodiments, the structural diaphragm 850 material may be made of structural foam, etc.

Figure 8F:
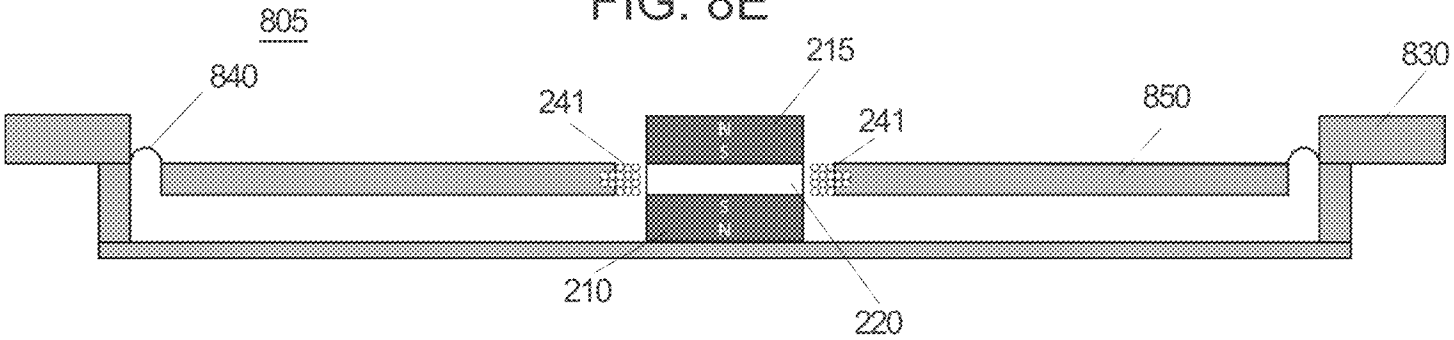
FIG. 8F illustrates a cross-sectional view of an example ultra-thin transducer with an alternative shaped voice coil, a structural diaphragm and outer suspension, according to some embodiments.

FIG. 8F illustrates a cross-sectional view of an example ultra-thin transducer 805 with an alternative shaped voice coil 241, a structural diaphragm 850 and an outer suspension 840, according to some embodiments. In some embodiments, the transducer 805 includes a lower magnet 210, an upper magnet 215, a middle plate 220, voice coil 241, the structural diaphragm 850, outer suspension 840 and structure (or frame) 830. In some embodiments, the voice coil 241 has a different overall shape than voice coil 240 (FIG. 2A) in that the shape may be asymmetric or semi-asymmetric (e.g., reduced dimensions, angled, varied thickness, varied width/height, etc.).

Figure 8G:
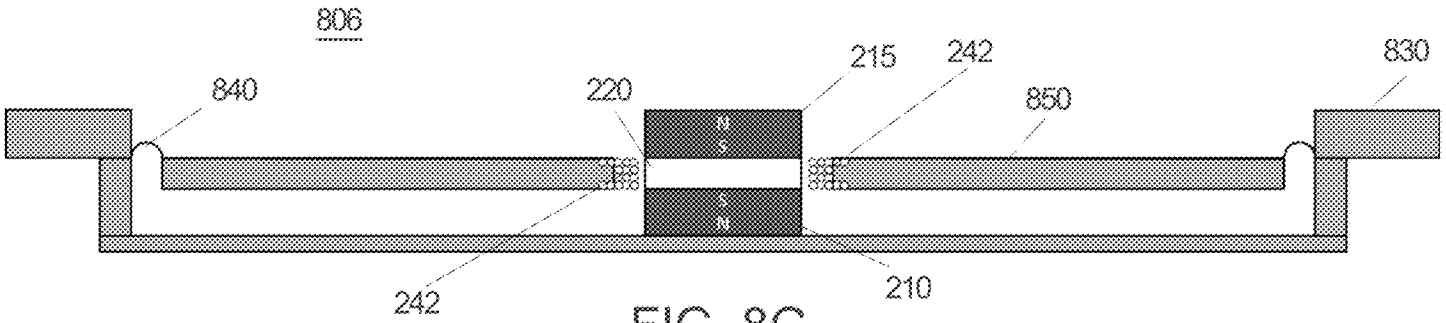
FIG. 8G illustrates a cross-sectional view of an example ultra-thin transducer with another alternative shaped voice coil, a structural diaphragm and outer suspension, according to some embodiments.

FIG. 8G illustrates a cross-sectional view of an example ultra-thin transducer 806 with another alternative shaped voice coil 242, a structural diaphragm 850 and outer suspension 840, according to some embodiments. In some embodiments, the transducer 806 includes a lower magnet 210, an upper magnet 215, a middle plate 220, voice coil 241, the structural diaphragm 850, outer suspension 840 and structure (or frame) 830. In some embodiments, the voice coil 242 has a different overall shape than voice coil 240 (FIG. 2A) and voice coil 241 (FIG. 8F) in that the shape may be another asymmetric shape or semi-asymmetric (e.g., reduced dimensions, angled, varied thickness, varied width/height, etc.).

Figure 8H:
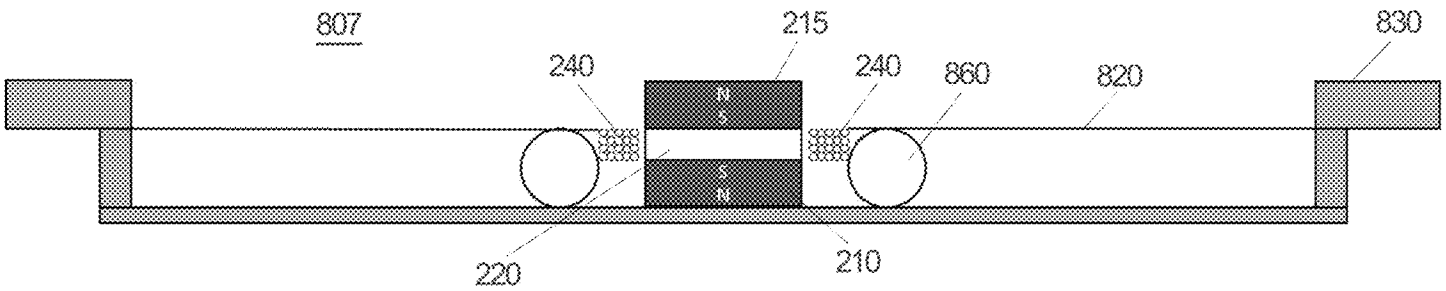
FIG. 8H illustrates a cross-sectional view of another example ultra-thin transducer with a planar diaphragm and inner suspension, according to some embodiments.

FIG. 8H illustrates a cross-sectional view of another example ultra-thin transducer 807 with a planar diaphragm 820 and inner suspension 860, according to some embodiments. In some embodiments, the transducer 807 includes a lower magnet 210, an upper magnet 215, a middle plate 220, voice coil 240, diaphragm 820, inner suspension 860 and structure (or frame) 830. In some embodiments, the inner suspension 860 may be a foam suspension, a poly-foam suspension, etc.

Figure 8I:
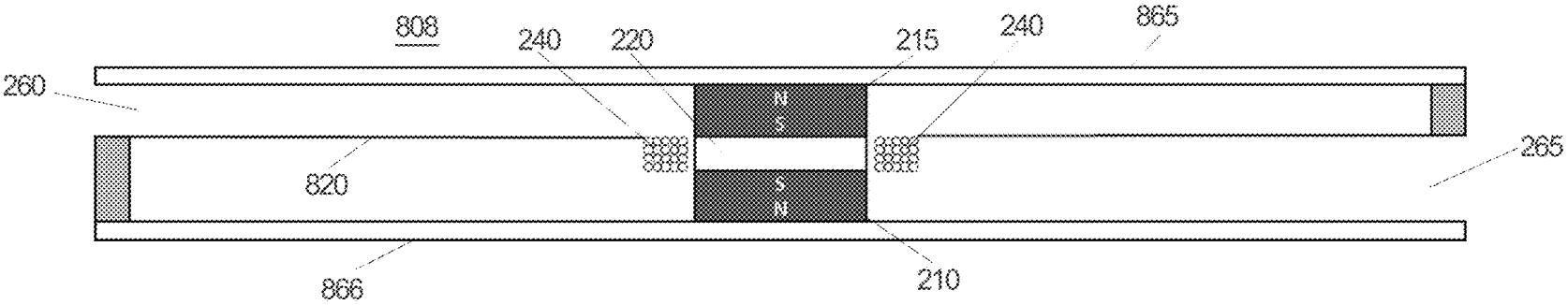
FIG. 8I illustrates a cross-sectional view of an example ultra-thin transducer with a planar diaphragm, a top plate and a back plate, which is configured for slot radiation, according to some embodiments.

FIG. 8I illustrates a cross-sectional view of an example ultra-thin transducer 808 with a planar diaphragm 820, a top plate 865 and a back plate 866, which is configured for slot radiation, according to some embodiments. In some embodiments, the transducer 808 includes a lower magnet 210, an upper magnet 215, a middle plate 220, voice coil 240, diaphragm 820, top plate 865 and back plate 866. In some embodiments, the slot or venting 260 radiates sound waves into the listening environment (e.g., a room, etc.), and the slot or venting 265 radiates sound waves internally into the speaker volume. In some embodiments, the top plate 865 and the back plate 866 may be made of low carbon steel, soft magnetic steel, etc.

Figure 8J:
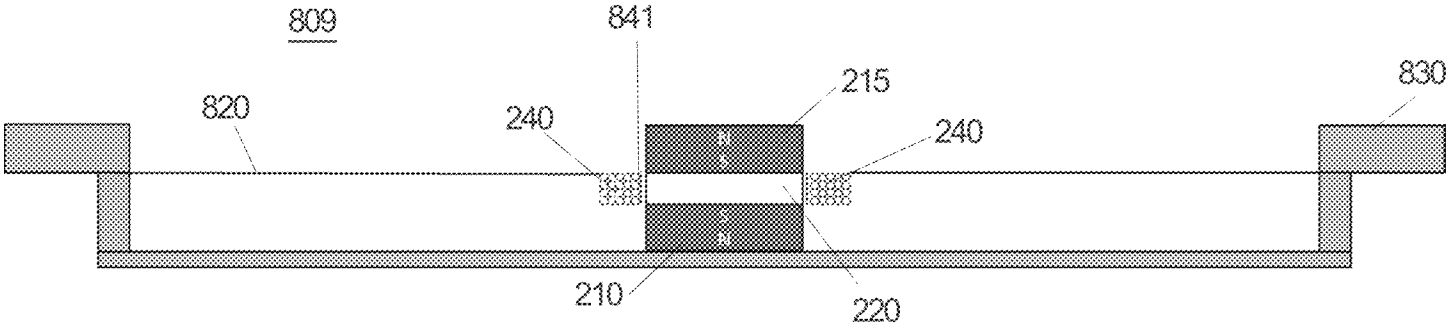
FIG. 8J illustrates a cross-sectional view of an example ultra-thin transducer with a planar diaphragm and ferrofluid seal, according to some embodiments.

FIG. 8J illustrates a cross-sectional view of an example ultra-thin transducer 809 with a planar diaphragm 820 and ferrofluid seal 841, according to some embodiments. In some embodiments, the transducer 809 includes a lower magnet 210, an upper magnet 215, a middle plate 220, voice coil 240, diaphragm 820, ferrofluid seal 841 and structure (or frame) 830. The ferrofluid seal 841 takes advantage of the response of a magnetic fluid to an applied magnetic field of the magnet system of the transducer 809. The ferrofluid may function as a liquid O-ring. The ferrofluid seal 841 enables the transducer 809 to function more efficiently, with improved audio response and better power handling. Audio ferrofluids are based on two classes of carrier liquid: synthetic hydrocarbons and esters. Both oils possess very low volatility and high thermal stability. The saturation magnetization (the maximum value of the magnetic moment per unit volume when all the domains are aligned) is determined by the nature of the suspended magnetic material and by the volumetric loading of the material. The physical and chemical properties such as density and viscosity correspond closely to those of the carrier liquid.

Figure 8K:
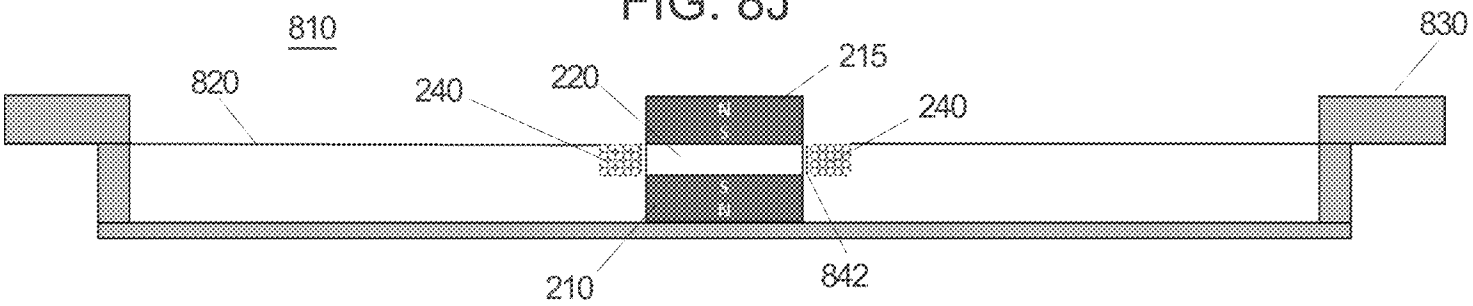
FIG. 8K illustrates a cross-sectional view of an example ultra-thin transducer with a planar diaphragm and grease seal, according to some embodiments.

FIG. 8K illustrates a cross-sectional view of an example ultra-thin transducer 810 with a planar diaphragm 820 and grease seal 842, according to some embodiments. In some embodiments, the transducer 810 includes a lower magnet 210, an upper magnet 215, a middle plate 220, voice coil 240, diaphragm 820, grease seal 842 and structure (or frame) 830. In some embodiments, the grease seal 842 may be a grease sealing compound type such as grease seal compounds including silicones, etc.

Figure 8L:
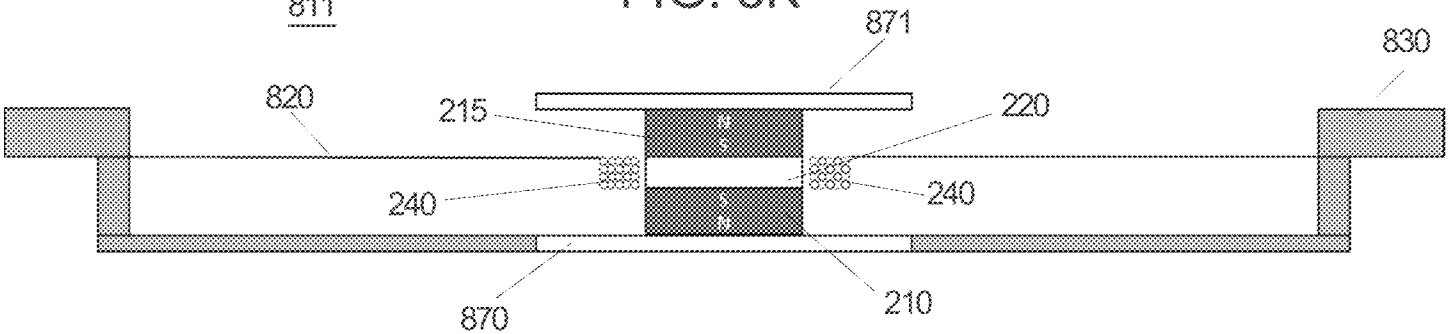
FIG. 8L illustrates a cross-sectional view of another example ultra-thin transducer with a planar diaphragm, a top plate and a back plate, according to some embodiments.

FIG. 8L illustrates a cross-sectional view of another example ultra-thin transducer 811 with a planar diaphragm 820, a top plate 871 and a back plate 870, according to some embodiments. In some embodiments, the transducer 811 includes a lower magnet 210, an upper magnet 215, a middle plate 220, voice coil 240, diaphragm 820, the top plate 871, the back plate 870 and structure (or frame) 830. In some embodiments, the top plate 871 and the back plate 870 may be made of low carbon steel, soft carbon steel, etc. In some embodiments, the back plate 870 may be formed or integrated with the structure (or frame) 830.

Figure 8M:
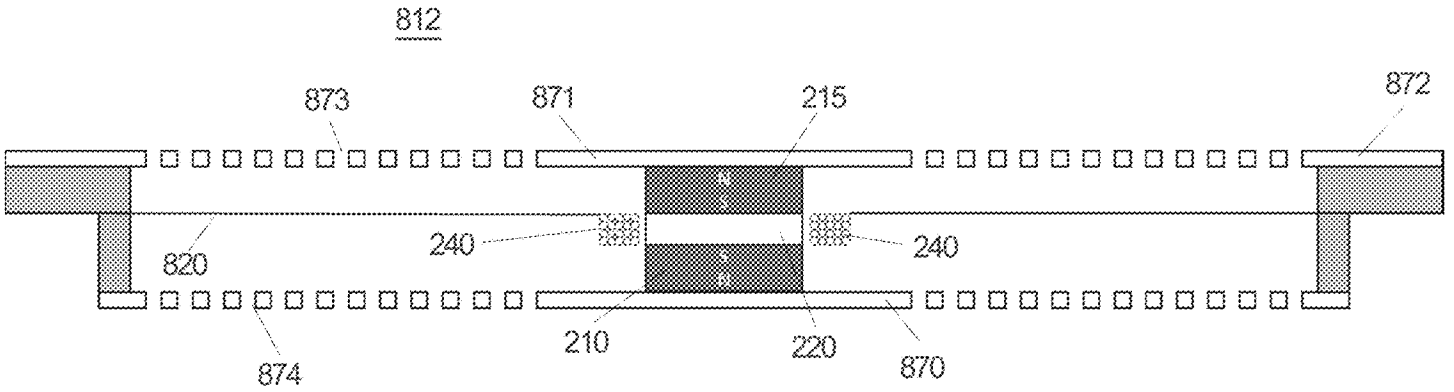
FIG. 8M illustrates a cross-sectional view of an example ultra-thin transducer with a planar diaphragm, a perforated top plate and a perforated back plate, according to some embodiments.

FIG. 8M illustrates a cross-sectional view of an example ultra-thin transducer 812 with a planar diaphragm 820, a perforated top plate 871/872/873 and a perforated back plate 870/874, according to some embodiments. In some embodiments, the transducer 812 includes a lower magnet 210, an upper magnet 215, a middle plate 220, voice coil 240, the diaphragm 820, the top plate 871/872/873 (see also FIG. 13), the back plate 870/874. In some embodiments, the top plate 871/872/873 and back plate 870/874 can be made of low carbon steel, soft magnetic steel, etc., and some portions of the top plate and back plate (873, 874) may be perforated to allow sound to radiate into the listening environment and the speaker enclosure, while other portions of the top plate and the back plate (870, 871) are solid to maximize flux near the voice coil 240. It is noted that while the ultra-thin transducer 812 is shown for direct radiation of sound (as opposed to slot radiation), some embodiments may include a combination of slot radiation and direct radiation.

Figure 8N:
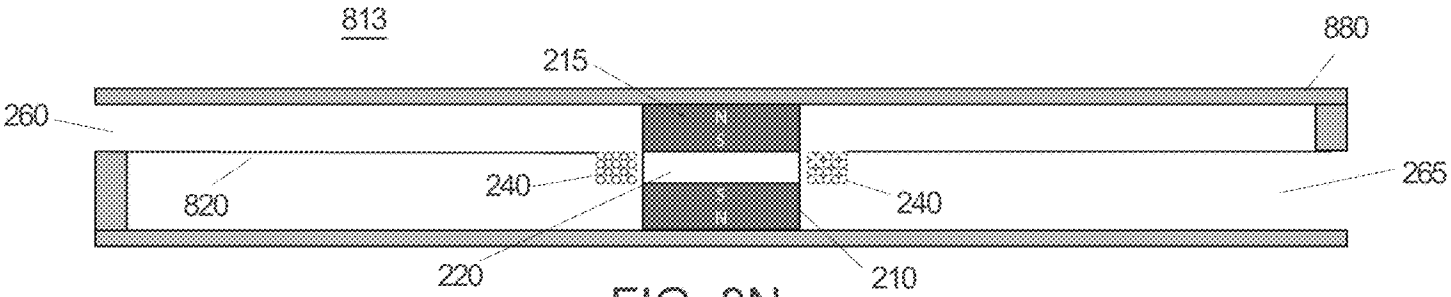
FIG. 8N illustrates a cross-sectional view of an example ultra-thin transducer with a planar diaphragm that is configured for slot radiation, according to some embodiments.

FIG. 8N illustrates a cross-sectional view of an example ultra-thin transducer 813 with a planar diaphragm 820 that is configured for slot radiation, according to some embodiments. In some embodiments, the transducer 813 includes a lower magnet 210, an upper magnet 215, a middle plate 220, voice coil 240, diaphragm 820 and frame 880. In some embodiments, the slot or venting 260 radiates sound waves into the listening environment (e.g., a room, etc.), and the slot or venting 265 radiates sound waves internally into the speaker volume. In some embodiments, frame 880 may be made of low carbon steel, soft magnetic steel, plastic, aluminum, etc.

Figure 8O:
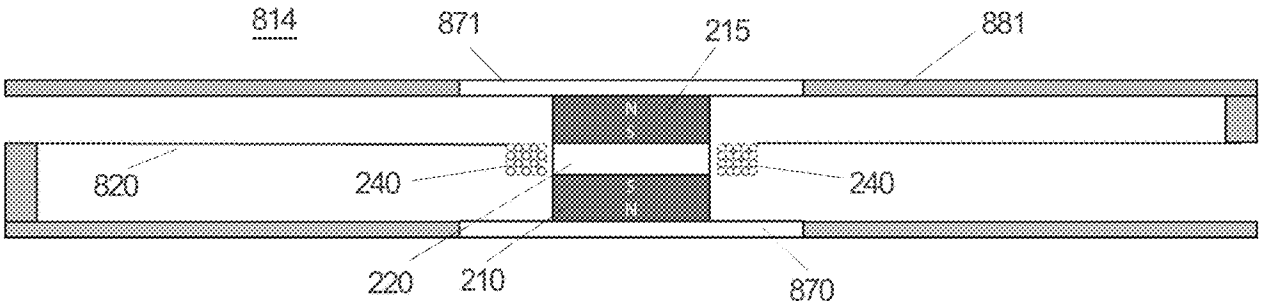
FIG. 8O illustrates a cross-sectional view of an example ultra-thin transducer with a planar diaphragm, a top plate and a back plate, which is configured for slot radiation, according to some embodiments.

FIG. 8O illustrates a cross-sectional view of an example ultra-thin transducer 814 with a planar diaphragm 820, a top plate 871 and a back plate 870, which is configured for slot radiation, according to some embodiments. In some embodiments, the transducer 814 includes a lower magnet 210, an upper magnet 215, a middle plate 220, voice coil 240, diaphragm 820, the back plate 870, the top plate 871 and structure (or frame) 881. In some embodiments, the slot or venting 260 radiates sound waves into the listening environment (e.g., a room, etc.), and the slot or venting 265 radiates sound waves internally into the speaker volume. In some embodiments, frame 881 may be made of low carbon steel, soft magnetic steel, plastic, aluminum, etc. In some embodiments, the back plate 870 and the top plate 871 may be formed or integrated with the structure (or frame) 881.

Figure 9A:
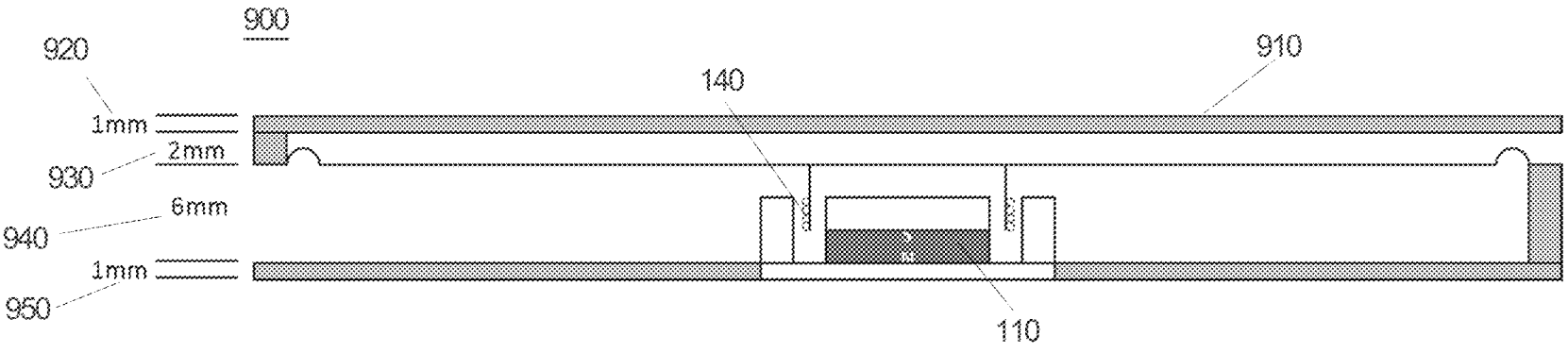
FIG. 9A illustrates a cross-sectional view of an example traditional transducer with a planar diaphragm that is configured for slot radiation.

FIG. 9A illustrates a cross-sectional view of an example traditional transducer 900 with a planar diaphragm that is configured for slot radiation. The transducer 900 includes a frame 910 with a top portion having a width 920 of 1 mm, a connecting portion having a width 930 of 2 mm, a width 940 of 6 mm, and a bottom portion having a width 950 of 1 mm. The total thickness is 10 mm and the transducer 900 has a 2 mm peak displacement.

Figure 9B:
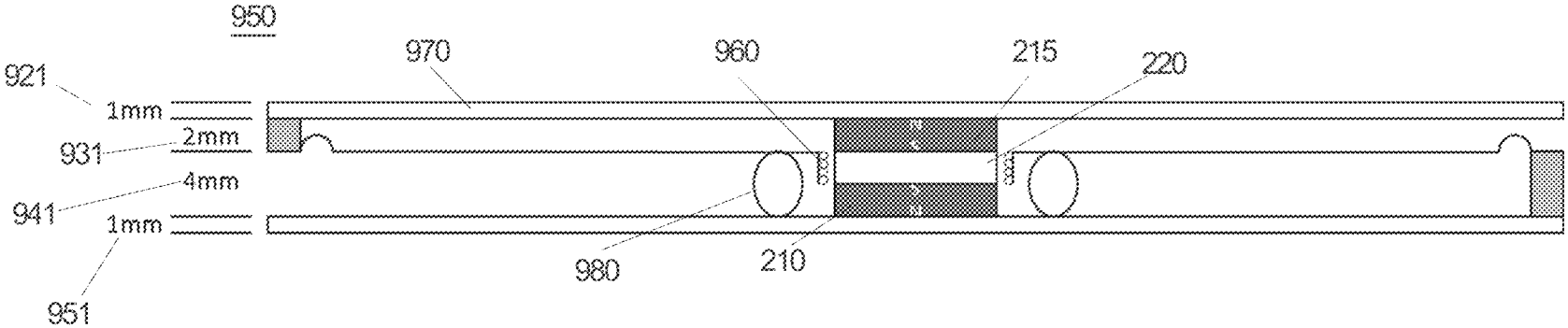
FIG. 9B illustrates a cross-sectional view of an example ultra-thin transducer with a planar diaphragm that is configured for slot radiation, according to some embodiments.

FIG. 9B illustrates a cross-sectional view of an example ultra-thin transducer 950 with a planar diaphragm that is configured for slot radiation, according to some embodiments. The transducer 950 includes a voice coil 960 (e.g., similar to voice coil 240, FIG. 2A), a frame 970 with a top portion having a width 921 of 1 mm, a connecting portion having a width 931 of 2 mm, a width 941 of 4 mm and a bottom portion having a width 951 of 1 mm, and internal suspension 980 (e.g., similar to internal suspension 860, FIG. 8H). The total thickness is 8 mm and the transducer 950 has a 2 mm peak displacement. The transducer 950 has a total thickness that is 20% (i.e., 2 mm) less than the transducer 900.

Figure 10A:
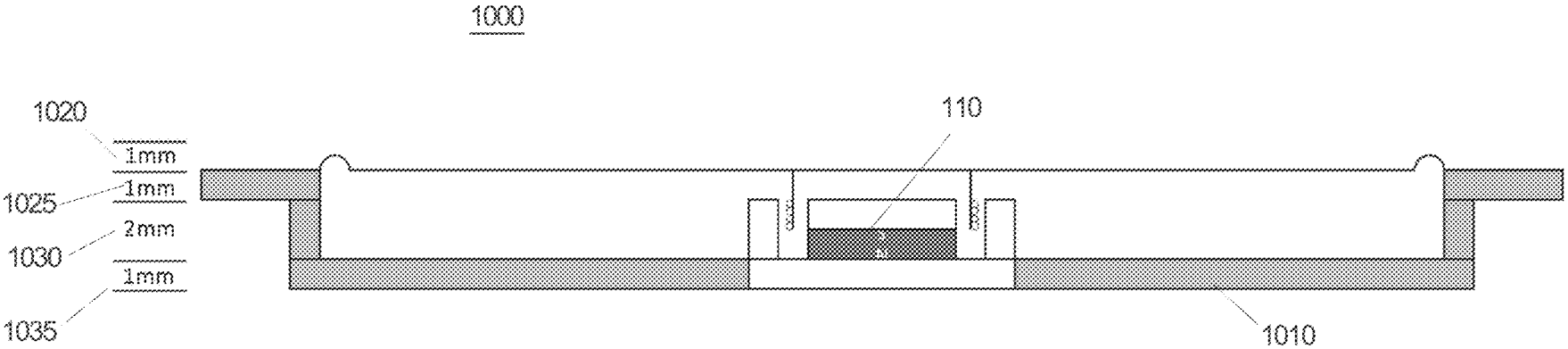
FIG. 10A illustrates a cross-sectional view of an example traditional transducer with a planar diaphragm that is configured for direct radiation.

FIG. 10A illustrates a cross-sectional view of an example traditional transducer 1000 with a planar diaphragm that is configured for direct radiation. The transducer 1000 has a peak displacement 1020 of 1 mm, a top portion having a width 1025 of 1 mm, a connecting portion having a width 1030 of 2 mm, and a bottom portion 1010 having a width 1035 of 1 mm. The total thickness is 5 mm.

Figure 10B:
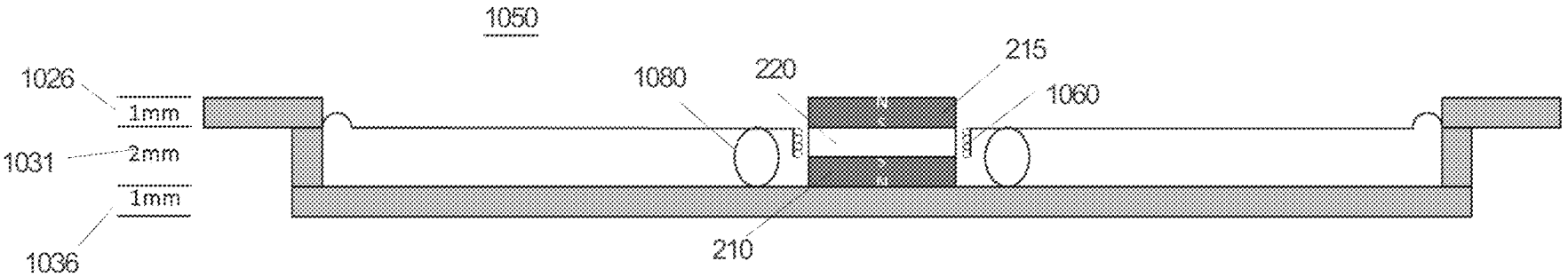
FIG. 10B illustrates a cross-sectional view of an example ultra-thin transducer with a planar diaphragm that is configured for direct radiation, according to some embodiments.

FIG. 10B illustrates a cross-sectional view of an example ultra-thin transducer 1050 with a planar diaphragm that is configured for direct radiation, according to some embodiments. The transducer 1050 includes a voice coil 1060 (e.g., similar to voice coil 240, FIG. 2A), an inner suspension 1080 (similar to internal suspension 860, FIG. 8H) with a top portion having a width 1026 of 1 mm, a connecting portion having a width 1031 of 2 mm and a bottom portion having a width 1036 of 1 mm. The total thickness of the transducer 1050 is 4 mm and the peak displacement is 1 mm. The transducer 1050 has a total thickness that is 20% (i.e., 2 mm) less than the transducer 1000.

Figure 11A:
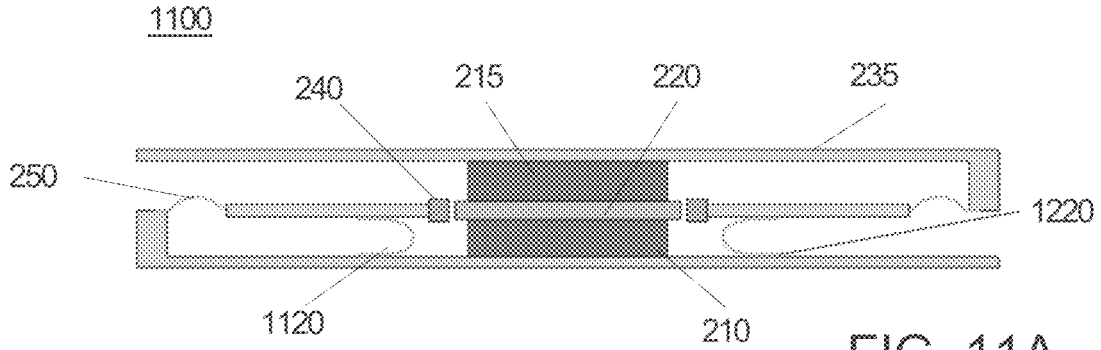
FIG. 11A illustrates a cross-sectional view of an example ultra-thin transducer with inner surround to assist in preventing short circuiting, according to some embodiments.

FIG. 11A illustrates a cross-sectional view of an example ultra-thin transducer 1100 with inner surround 1120 to assist in preventing short circuiting, according to some embodiments. When a diaphragm moves forward, it compresses the air in front of it while, a opposite end, there is rarefaction of the medium. This creates a phase difference of 180°. At low frequencies, the diaphragm moves slowly such that the air can move from one side to the other and balance out the difference in pressure. This produces a low-frequency air flow but no sound (acoustic circuit). In some embodiments, the addition of the inner surround 1120 assists to prevent acoustic short circuiting from happening. The inner surround 1120 may be made of foal, rubber, etc.

Figure 11B:
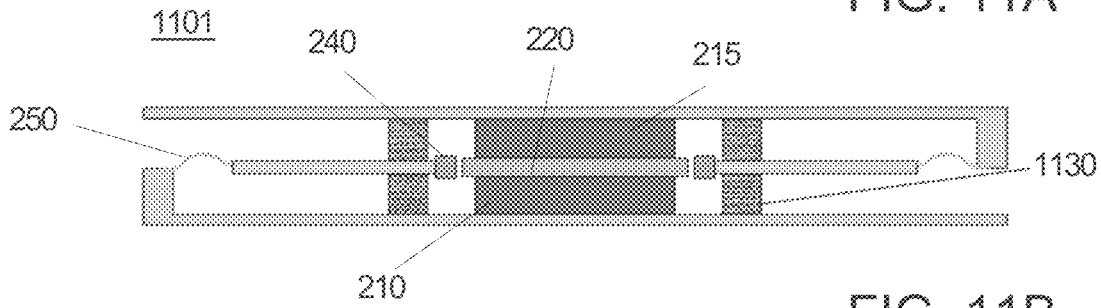
FIG. 11B illustrates a cross-sectional view of an example ultra-thin transducer with compressible material to prevent acoustic short circuiting, according to some embodiments.

FIG. 11B illustrates a cross-sectional view of an example ultra-thin transducer 1101 with compressible material 1130 to prevent acoustic short circuiting, according to some embodiments. In one embodiment, the compressible material 1130 may be a compressible foam or similar material. In some embodiments, the addition of the compressible material 1130 assists to prevent acoustic short circuiting from happening.

Figure 11C:
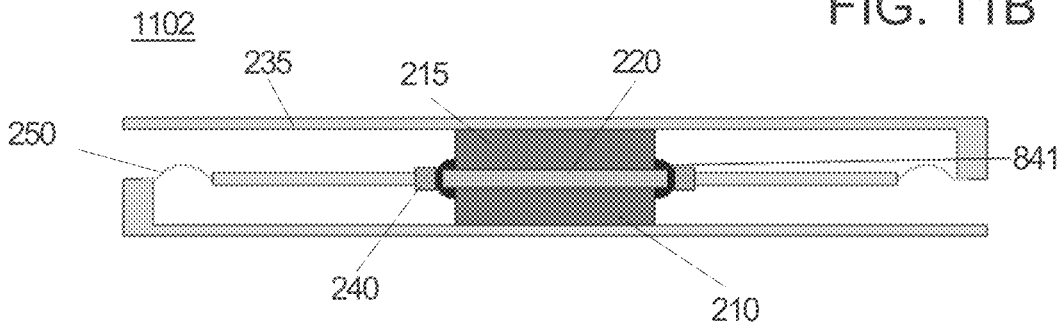
FIG. 11C illustrates a cross-sectional view of an example ultra-thin transducer with a ferrofluid seal, according to some embodiments.

FIG. 11C illustrates a cross-sectional view of an example ultra-thin transducer 1102 with a ferrofluid seal 841 (see also FIG. 8J), according to some embodiments. In some embodiments, the addition of the ferrofluid seal 841 assists to prevent acoustic short circuiting from happening and may also reduce the propensity for rocking.

Figure 12A:
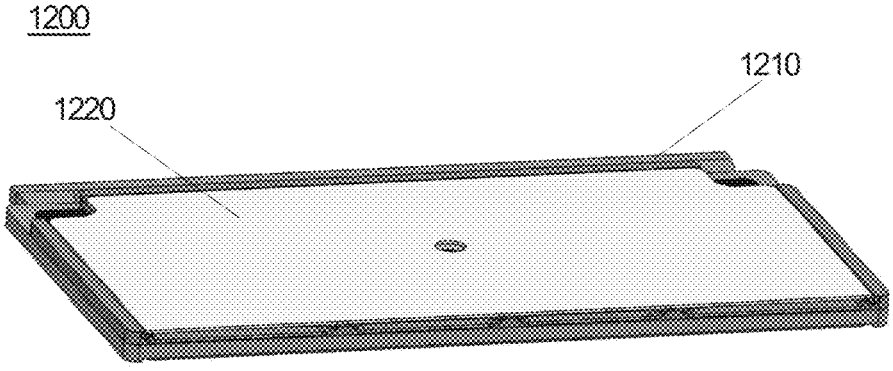
FIG. 12A illustrates a top perspective view of an example ultra-thin transducer with a top plate, according to some embodiments.
Figure 12B:
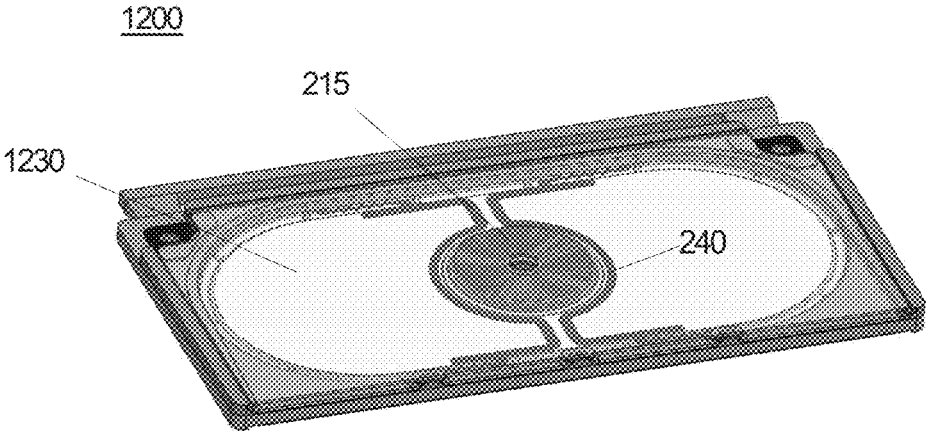
FIG. 12B illustrates a top perspective view of the example ultra-thin transducer of FIG. 12A with the top plate removed, according to some embodiments.
Figure 12C:
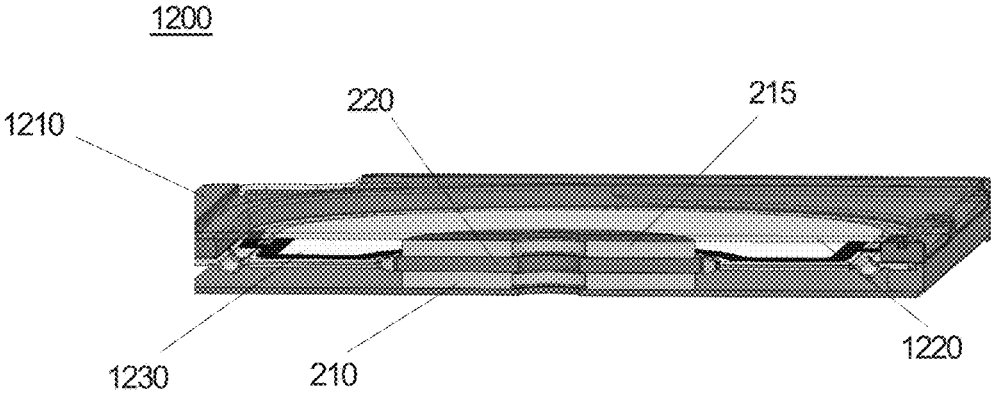
FIG. 12C illustrates a cross-sectional view of the example ultra-thin transducer of FIGS. 12A-B, according to some embodiments.

FIG. 12A illustrates a top perspective view of an example ultra-thin transducer 1200 with a top plate 1220, according to some embodiments. The transducer 1220 includes a frame 1210 for supporting and mounting the transducer 1200. FIG. 12B illustrates a top perspective view of the example ultra-thin transducer 1200 of FIG. 12A with the top plate 1220 removed, according to some embodiments. As shown, the transducer 1200 includes a magnet system including the top magnet 215, voice coil 240 and diaphragm 1230 (e.g., similar to diaphragm 520, FIG. 5A). FIG. 12C illustrates a cross-sectional view of the example ultra-thin transducer 1200 of FIGS. 12A-B, according to some embodiments.

Figure 13:
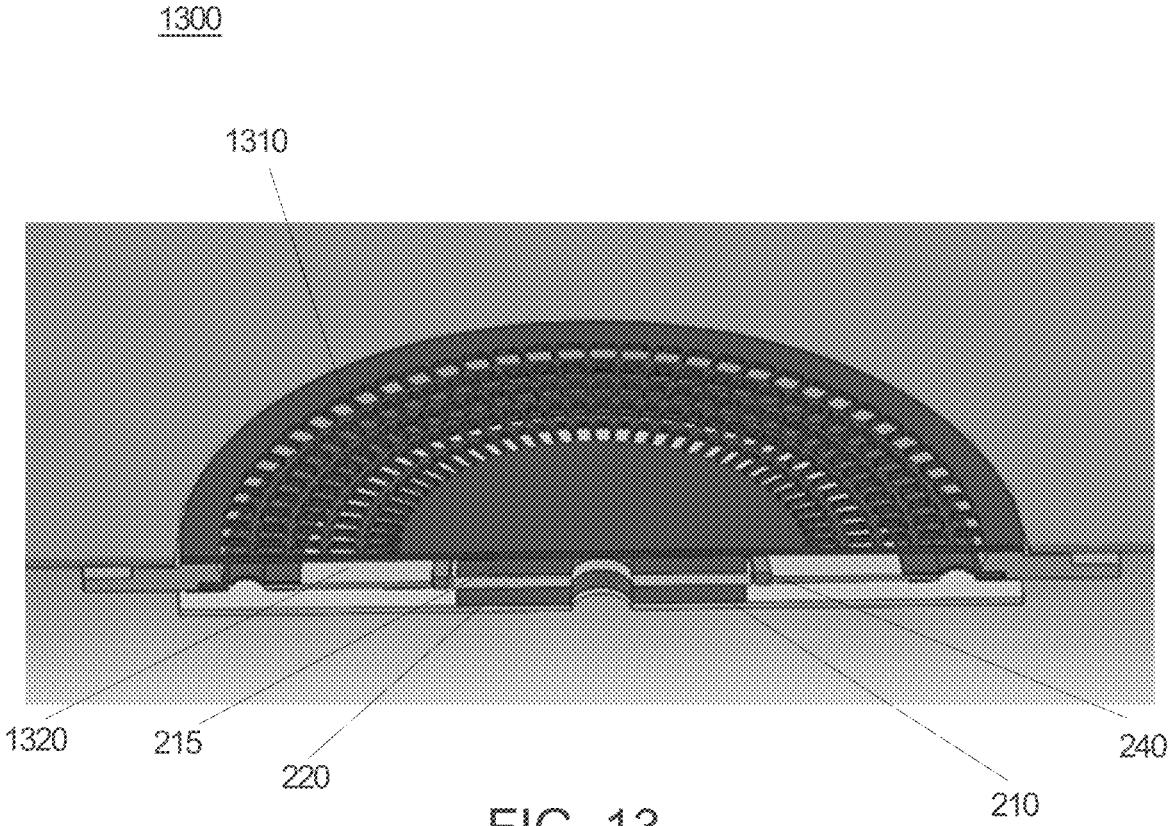
FIG. 13 illustrates a cross-sectional view of an example ultra-thin transducer with a perforated top plate, according to some embodiments.

FIG. 13 illustrates a cross-sectional view of an example ultra-thin transducer 1300 with a perforated top plate 1310, according to some embodiments. In some embodiments, the transducer 1300 includes the magnet system (see also, FIG. 2A), voice coil 240 and diaphragm 1320. In some embodiments, the sound waves radiate out through the perforations of the top plate 1310. In some embodiments, the diaphragm 1320 has a circular or round shape.

Figure 14:
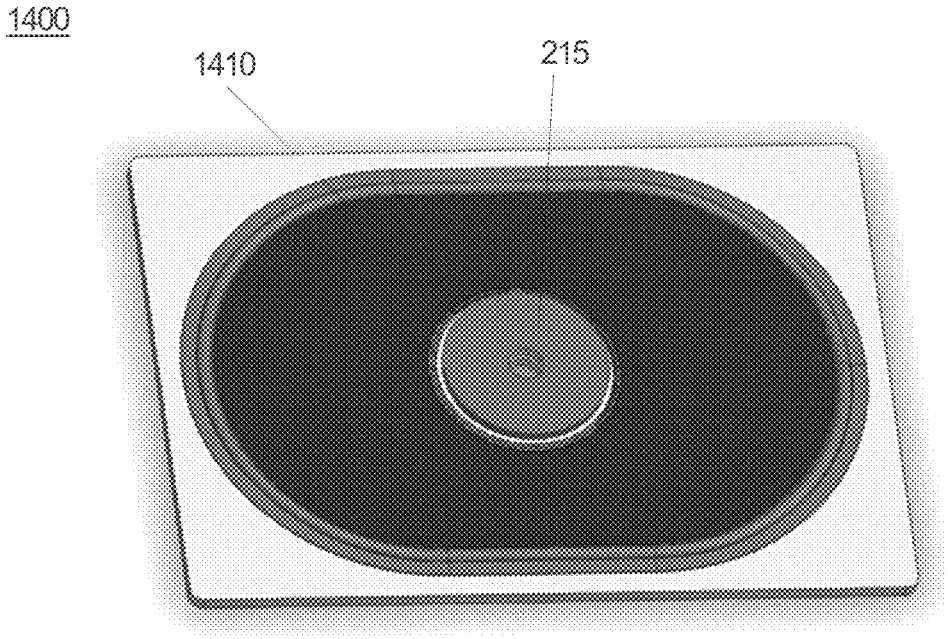
FIG. 14 illustrates a top view of another example ultra-thin transducer with an oval shaped diaphragm, according to some embodiments.

FIG. 14 illustrates a top view of another example ultra-thin transducer 1400 with an oval shaped diaphragm 1410, according to some embodiments. It should be noted that various diaphragm shapes may be employed, such as different sized circular shapes, oval shapes, etc.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of pre-AIA 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A slim acoustic transducer comprising:

a diaphragm including a hole that is substantially centered on a vertical axis of the diaphragm, the hole having a first horizontal width;

a voice coil directly attached to the diaphragm, the voice coil having a ring shape, the ring shape being disposed at least partially within the hole and substantially centered on the vertical axis, the ring shape having an outer horizontal width and an inner horizontal width, the outer horizontal width being smaller than or equal to the first horizontal width of the hole;

a column structure disposed at least partially within the ring shape and substantially centered on the vertical axis, the column structure having a second horizontal width that is smaller than or equal to the inner horizontal width of the ring shape, the column structure comprising:

an upper magnet;

a middle plate disposed below the upper magnet; and a lower magnet disposed below the middle plate.

2. The transducer of claim 1, wherein:

the hole and the ring shape are circular;

the column structure is cylindrical; and the first horizontal width, the outer horizontal width, the inner horizontal width, and the second horizontal width are diameters.

3. The transducer of claim 1, wherein:

the upper magnet is configured to apply an upper magnetic field to the voice coil;

the lower magnet is configured to apply a lower magnetic field to the voice coil;

the middle plate is configured to guide at least one of the upper magnetic field or the lower magnetic field toward the voice coil; and the hole of the diaphragm is movable relative to the column structure that is fixed.

4. The transducer of claim 1, further comprising:

a suspension attached to the diaphragm, wherein the suspension comprises at least one of an inner suspension or an outer suspension, and the column is disposed within the hole of the diaphragm.

5. The transducer of claim 1, further comprising:

a lubricant disposed between the voice coil and the column structure.

6. The transducer of claim 5, wherein the lubricant comprises at least one of ferrofluid or grease.

7. The transducer of claim 1, further comprising:

a top plate disposed above the upper magnet and substantially centered on the vertical axis, wherein the top plate is configured to assist in directing at least a portion of the upper magnetic field toward the voice coil; and a bottom plate disposed below the lower magnet and substantially centered on the vertical axis, wherein the bottom plate is configured to assist in directing at least a portion of the lower magnetic field toward the voice coil.

8. The transducer of claim 7, further comprising:

at least one magnetic flux guide coupled to the top plate; and at least one magnetic flux guide coupled to the bottom plate.

9. The transducer of claim 1, wherein:

the upper magnet and the lower magnet include neodymium;

the middle plate includes low carbon steel; and the diaphragm is one of planar shaped, concave shaped or convex shaped.

10. The transducer of claim 1, wherein the diaphragm comprises structural foam.

11. An acoustic transducer comprising:

a diaphragm including a hole that is substantially centered on a vertical axis of the diaphragm, the hole having a first horizontal width;

a voice coil directly attached to the diaphragm, the voice coil having a ring shape, the ring shape being disposed at least partially within the hole and substantially centered on the vertical axis, the ring shape having an outer horizontal width and an inner horizontal width, the outer horizontal width being smaller than or equal to the first horizontal width of the hole; and a magnetic column structure disposed at least partially within the ring shape and substantially centered on the vertical axis.

12. The transducer of claim 11, wherein the magnetic column structure includes a second horizontal width that is smaller than or equal to the inner horizontal width of the ring shape.

13. The transducer of claim 12, wherein:

the magnetic column structure comprises:

an upper magnet;

a middle plate disposed below the upper magnet; and a lower magnet disposed below the middle plate; and the hole of the diaphragm is movable relative to the magnetic column structure that is fixed.

14. The transducer of claim 13, wherein:

the hole and the ring shape are circular;

the magnetic column structure is cylindrical;

the first horizontal width, the outer horizontal width, the inner horizontal width, and the second horizontal width are diameters;

the upper magnet is configured to apply an upper magnetic field to the voice coil;

the lower magnet is configured to apply a lower magnetic field to the voice coil;

the middle plate is configured to guide at least one of the upper magnetic field or the lower magnetic field toward the voice coil; and the magnetic column structure is disposed within the hole of the diaphragm.

15. The transducer of claim 14, further comprising:

a top plate disposed above the upper magnet and substantially centered on the vertical axis, wherein the top plate is configured to assist in directing at least a portion of the upper magnetic field toward the voice coil; and a bottom plate disposed below the lower magnet and substantially centered on the vertical axis, wherein the bottom plate is configured to assist in directing at least a portion of the lower magnetic field toward the voice coil.

16. The transducer of claim 15, further comprising:

at least one magnetic flux guide coupled to the top plate; and at least one magnetic flux guide coupled to the bottom plate.

17. The transducer of claim 13, wherein:

the upper magnet and the lower magnet include neodymium, and the middle plate includes low carbon steel; and the diaphragm is one of planar shaped, concave shaped or convex shaped.

18. The transducer of claim 11, further comprising:

a suspension attached to the diaphragm, wherein the suspension comprises at least one of an inner suspension or an outer suspension; and a lubricant disposed between the voice coil and the column structure.

19. The transducer of claim 18, wherein the lubricant comprises at least one of ferrofluid or grease.

20. The transducer of claim 11, wherein the diaphragm comprises structural foam.

* * * * *